United States Patent [19]

Larsen

[11] Patent Number: 4,981,070

[45] Date of Patent: Jan. 1, 1991

[54] MULTI-PART PISTON FOR SERVOMOTOR

[75] Inventor: Preben K. Larsen, Sønderborg, Denmark

[73] Assignee: Danfoss A/S, Nordborg, Denmark

[21] Appl. No.: 289,734

[22] Filed: Dec. 27, 1988

[30] Foreign Application Priority Data

Jan. 16, 1988 [DE] Fed. Rep. of Germany ..... 3801137

[51] Int. Cl.[5] ..... F15B 15/14

[52] U.S. Cl. ..... 92/193; 92/257; 92/258

[58] Field of Search ..... 92/85 R, 193, 201, 205, 92/247, 255, 257, 258, 250

[56] References Cited

U.S. PATENT DOCUMENTS

| | | | |
|---|---|---|---|
| 780,199 | 1/1905 | Key | 92/193 |
| 1,274,783 | 8/1918 | Renard | 92/258 |
| 1,372,262 | 3/1921 | Yount | 92/258 X |
| 3,101,651 | 8/1963 | Strader | 92/258 X |
| 3,563,508 | 2/1971 | DeLorenzo | 92/257 X |

FOREIGN PATENT DOCUMENTS

| | | | |
|---|---|---|---|
| 2712669 | 9/1978 | Fed. Rep. of Germany | 92/85 R |

*Primary Examiner*—Edward K. Look
*Assistant Examiner*—George Kapsalas
*Attorney, Agent, or Firm*—Wayne B. Easton; Clayton R. Johnson

[57] ABSTRACT

A servomotor is actuated by a pressure medium and has a piston reciprocated in the cylinder, the piston being mounted by a piston rod that extends through a cylinder end wall. The piston has a piston member bearing against the cylinder and is mounted for radial movement relative to the piston rod by a pair of piston guide plates that extend on opposite sides of the piston member. The guide plates are mounted by the piston rod for axial movement therewith.

13 Claims, 2 Drawing Sheets

MULTI-PART PISTON FOR SERVOMOTOR

BACKGROUND OF THE INVENTION

The invention relates to a servomotor actuated by a pressure medium, comprising a piston reciprocatable in a cylinder and a piston rod brought out at one side, the piston being movable relatively to the piston rod and its central portion being for this purpose arranged between annular faces on the piston rod.

A known servomotor of this kind (U.S. Pat. No. 31 58 072) has a long stroke. The piston has a small diameter and a long axial length. By reason of these dimensions, it is well guided in the cylinder. Since the piston is secured to the piston rod with the interpositioning of elastic rings, it can move at will relative to the piston rod. There is therefore no danger of the piston jamming if the free end of the piston rod that carries the piston moves out of centre because the piston rod is guided in only one end wall of the cylinder.

Under otherwise identical conditions, however, the small piston diameter requires a comparatively high actuating pressure and the length of the piston contributes considerably to the cylinder length, which is particularly significant in the case of servomotors with a short stroke.

The invention is based on the problem of providing a servomotor of the aforementioned kind which, under otherwise identical prerequisites, can be driven at a lower pressure and made of a shorter length.

SUMMARY OF THE INVENTION

This problem is solved according to the invention in that the external diameter of the piston is a multiple of the axial length of its circumference and that the annular faces are so closely juxtaposed that they form a radial guide for the piston.

This piston has a large diameter in comparison with its axial length. A predetermined actuating force is therefore achieved with a lower pressure. The cylinder length can also be kept shorter. In addition, the piston can be lighter in weight so that it is more rapidly actuatable. Such a piston is no longer guided by the co-operation of the circumferential surface and the cylinder. Instead, it has a considerable tendency to tilt which would also arise in the case of the known elastic clamping and lead to jamming. For this reason, a radial guide is provided for the piston. This is readily achieved by the annular faces because, by reason of the large piston diameter, a correspondingly large guide surface can be made available. Departures of the piston rod axis from the cylinder axis are therefore compensated by a radial displacement. One can therefore arrange the piston in the cylinder with very little play (a few $\mu$), which leads to a correspondingly good seal.

It is favourable if the central portion of the piston is formed by an annular plate which is overlapped by the annular faces over a radial width at least equal to twice the thickness of the annular plate. Because of the piston dimensions, such a guide face is readily possible to achieve.

Preferably, the annular faces receive the annular plate therebetween with such a tight fit that it has play of less than 0.02 mm. This play is sufficient for a radial displacement of the annular plate but holds same exactly in the predetermined plane.

The thickness of the annular plate is desirably less than the axial length of the circumferential surface. This results in a very light piston.

In a preferred embodiment, the two annular faces are formed by two guide plates which are secured to the piston rod with the interpositioning of a spacer. Such a construction is easy to produce and assemble.

In particular, the spacer may be made in one piece with one of the guide plates at the inner periphery thereof. It is therefore only necessary to assemble two parts.

Preferably, the two guide plates are secured between a step of the piston rod and a beaded rim at the free end of the piston rod. This results in particularly simple manufacture and assembly. The beading forces are received by the spacer between the guide plates.

It is also favourable if an O-ring is disposed between the two guide faces and surrounded and radially compressed by the central portion of the piston. This O-ring brings about a seal. In addition, its elasticity ensures that there is a certain frictional connection in the radial direction between the piston rod and the piston. The O-ring can abut against the piston rod or, better still, against the spacer between the guide plates.

It is also possible to provide an annular expansion groove at the separating gap between the central portion and the guide face. This can be sufficient for sealing between the annular plate and the guide faces, especially with low pressure at which the inlet pressure is below 5 bar.

Preferably, the annular plate forming the central portion is then provided with the at least one expansion groove.

At least one expansion groove may also be provided at the circumferential surface of the piston. This serves sealing purposes at low pressures. At elevated pressures, a conventional sealing ring can also be used.

It is favourable if damping rings for abutment of the piston are provided at both ends of the cylinder concentric with the piston rod. This leads to noise reduction and the piston is mechanically protected. Desirably, the damping rings are disposed in the region of the guide plates. The incident forces are therefore not taken up by the piston and the latter is not damaged.

BRIEF DESCRIPTION OF THE DRAWINGS

Preferred examples of the invention will be described in more detail with reference to the drawing, wherein.

DETAILED DESCRIPTION OF THE PREFERRED EMBODIMENTS

Figure 1:
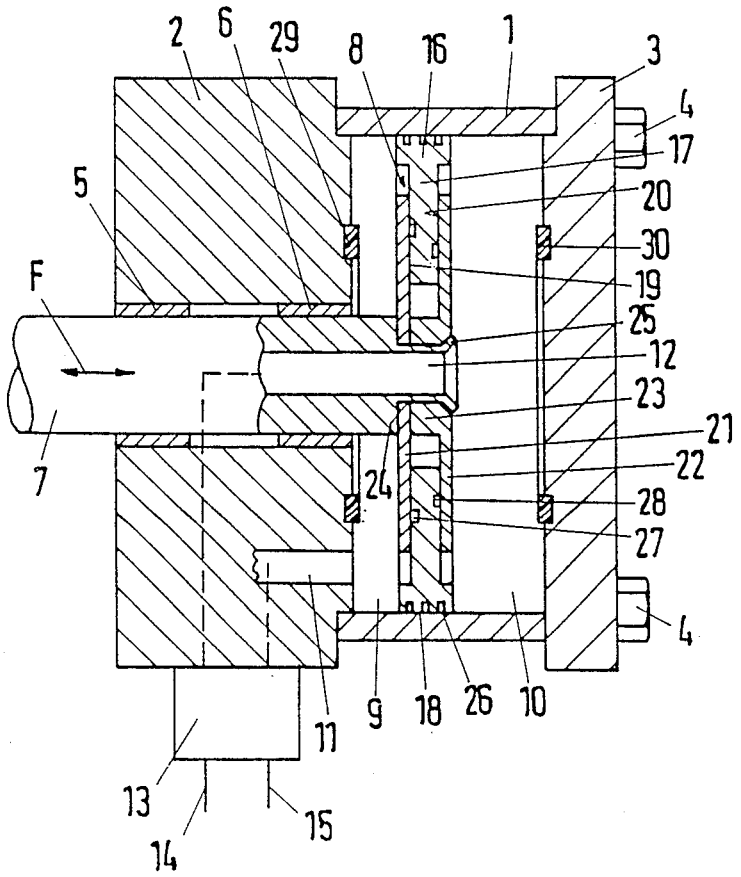
FIG. 1 is a longitudinal section through a first embodiment of a servomotor according to the invention and FIG. 2 is a longitudinal section through a second embodiment

The servomotor of FIG. 1 comprises a cylinder 1 closed at one end by a housing 2 and at the other by a cover 3, these parts being interconnected by screws 4. A piston rod 7 mounted in the housing 2 in bearings 5, 6 is brought out at one side and is reciprocatable in the direction of the arrow F. At the free end, it carries a piston 8 which subdivides the interior of the cylinder 1 into two pressure chambers 9, 10. The pressure chamber 9 can be connected to a control valve arrangement 13 by way of a passage 11 in the housing 2 and the pressure chamber 10 by way of a passage 12 in the piston rod 7, so that the pressure chamber 9 is connectable to a pressure medium discharge conduit 15 and vice versa. This leads to the axial reciprocating motion of the piston rod 7.

The piston 8 consists of a circumferential portion 16 and a central portion 17. The external diameter of the piston 8 is a multiple of, in this case eight times, the axial length of the circumferential surface 18. The central portion 17 is formed by a flat annular plate of which the thickness is still less than the axial length of the circumferential surface 18. Two annular faces 19, 20 formed on two annular plates 21, 22 form a radial guide for the piston 8. They abut the end faces of the annular plate 17 with a close fit. Consequently, the piston can be displaced radially during its reciprocation but it cannot tilt. The one annular plate 22 is made in one piece with an annular spacer 23 at the inner circumference. The arrangement consisting of the annular plates 21, 22 is secured between a step 24 of the piston rod 7 and a beaded rim 25 provided at the free end of the piston rod. The force to be received during beading is transmitted by way of the spacer 23 onto the shoulder 24.

To provide a better seal between the two pressure chambers 9, 10, three relief grooves 26 extending in the circumferential direction are provided in the circumferential surface 18. In addition, one relief groove 27, 28 is provided at each of the ends of the annular plate 17.

A damping ring 29 of elastic material is applied to the housing 2 and a damping ring 30 to the cover 3. These co-operate with the guide plates 20, 22 in order to damp noise.

As may be seen from FIG. 1, circumferential (radial outer) portion 16 has inner and outer diameters that are substantially larger than the than the outer diameter of each of guide plates 21, 22 and of substantially the same axial thickness as the corresponding spacing of the remote annular surfaces of the guide plates. Further the outer diameter of the radial inner central portion 17 where it is joined to portion 16 is of a substantially larger diameter than the outer diameters of the guide plates 21, 22 while the inner diameter of the piston central portion 17 is substantially less than the outer diameters of the radial outer parts of the guide plates. Further as may be seen the inner annular edge of portion 17 is substantially annularly spaced from the spacer portion 23.

Figure 2:
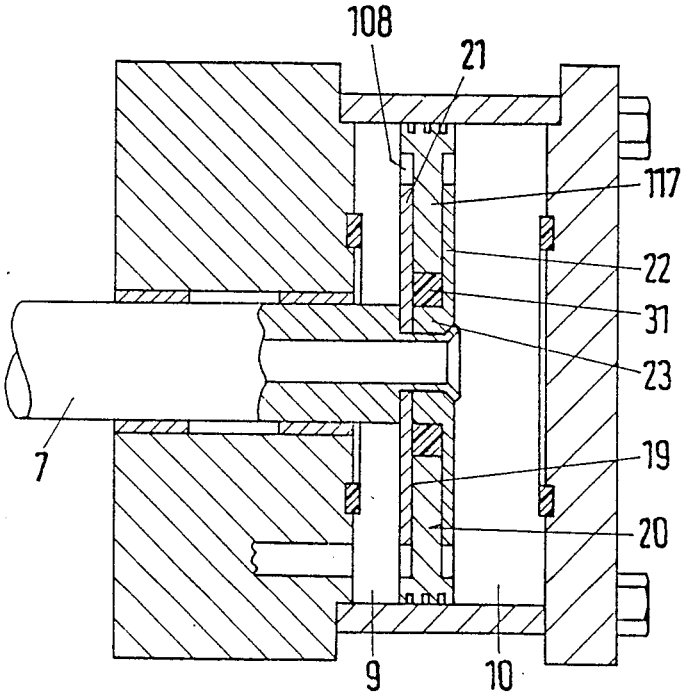

The FIG. 2 embodiment has much the same construction. The only difference is that the piston 108 has no relief grooves. Instead, there is a sealing ring 31 which is accommodated axially between the guide plates 21, 22 and in the radial direction between the annular plate 117 and the spacer 23 in a manner such that it undergoes slight radial compression. This sealing ring assists the seal between the two pressure chambers 9, 10. It also ensures a frictional connection between the piston 108 and piston rod 7.

Many alterations can be made to the illustrated embodiments without departing from the basic concept of the invention. Thus, the piston may have a thickness throughout corresponding to the axial length of the circumferential surface. The guide plates 21, 22 can be separately applied to the piston rod 7. The cylinder 1 may also be longer.

I claim:

1. A servomotor actuated by a pressure medium, comprising a cylinder assembly having an interior and an axial end wall, a piston rod axially slidably extended through the end wall and into the cylinder interior and a piston assembly mounted by the piston for axial movement therewith and dividing the cylinder assembly into a first and a second pressure chamber, the piston assembly including an annular piston having a radially outer annular portion that has a circumferential surface abutting against the cylinder assembly and an annular, radially central portion that has axially opposite annular surfaces, and first and second annular guide plates mounted by the piston rod and having axially adjacent annular surfaces parts forming a close fit with the piston central portion to form a radial guide for the piston to permit radial movement of the piston relative to the plates and the piston rod, the external diameter of the piston assembly being a multiple of the axial length of its outer circumferential surface, one of the guide plates having an annular spacer portion extending axially to the other guide plate and radially between the piston rod and the piston central portion, the outer portion having inner and outer diameters and the guide plates having inner and outer diameters, the outer portion inner diameter being substantially greater than the maximum outer diameters of the plates, and the axial dimension of the outer portion being greater than the corresponding dimension of the central portion.

2. A servomotor according to claim 1, characterized in that the outer portion is of an axial thickness that is greater than the axial spacing of the guide plates surface parts.

3. A servomotor according to claim 1, characterized in that the piston extends radially between the guide plates, the guide plates being in radial overlapping relationship by a radial width equal to at least twice the axial thickness of the guide plates, and that the central portion is radially displaceable relative to the guide plates.

4. A servomotor according to claim 3, characterized in that the guide plates form a sufficiently close fit with the piston member that the piston member has an axial play of less than 0.2 mm.

5. A servomotor according to claim 3, characterized in that the thickness of the central portion is less than the axial length of the piston assembly outer circumferential surface.

6. A servomotor actuated by a pressure medium, comprising a cylinder assembly having an interior and an axial end wall, a piston rod axially slidably extended through the end wall and into the cylinder interior and a piston assembly mounted by the piston rod for axial movement therewith and dividing the cylinder assembly into a first and a second pressure chamber, the piston assembly including an annular piston having a radially outer annular portion that has a circumferential surface abutting against the cylinder assembly and an annular radially central portion joined to the radially outer portion and having axially opposite annular surfaces, and first and second annular guide plates mounted by the piston rod and having axially adjacent annular surface parts forming a close fit with the piston central portion and having the central portion extending therebetween to form a radial guide for the piston for radial movement of the piston relative to the plates and the piston rod, the piston outer portion being of an axial dimension substantially greater than the maximum axial spacing of the guide plates adjacent surfaces.

7. A servomotor according to claim 6, characterized in there is provided an O-ring disposed axially between the guide plates, said O-ring being surrounded by the central portion and being radially compressed between the central portion and the piston rod.

8. A servomotor according to claim 6, characterized in that the central portion has at least one annular expansion groove opening axially to the axially adjacent guide plate.

9. A servomotor according to claim 6, characterized in that the piston outer portion has an annular expansion groove opening to the cylinder assembly.

10. A servomotor according to claim 6, characterized in that the radially outer portion has inner and outer diameters that are greater than the outer diameter of the plates.

11. A servomotor according to claim 6, characterized in that the guide plates have axially remote annular surfaces that are axially spaced by about the same as the axial dimension of the outer portion.

12. A servomotor according to claim 11, characterized that the central portion is joined to the outer portion to move therewith and is radially displaceable relative to the guide plates.

13. A servomotor according to claim 11, characterized in that the inner diameter of the outer portion is greater than that of the the outer diameters of the guide plates.

* * * * *